US008373365B2

(12) United States Patent
Liang

(10) Patent No.: US 8,373,365 B2
(45) Date of Patent: Feb. 12, 2013

(54) POWER SUPPLY WITH DIMMING CONTROL FOR HIGH-POWER DC LED LAMP

(75) Inventor: Chien Kuo Liang, Chung-Ho, Taipei County (TW)

(73) Assignee: Aeon Lighting Technology Inc., New Taipei (TW)

( * ) Notice: Subject to any disclaimer, the term of this patent is extended or adjusted under 35 U.S.C. 154(b) by 301 days.

(21) Appl. No.: 12/774,850

(22) Filed: May 6, 2010

(65) Prior Publication Data

US 2011/0273110 A1 Nov. 10, 2011

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/311; 315/291; 315/302

(58) Field of Classification Search ..... 315/185 R, 315/185 S, 291, 294, 298, 302, 311

See application file for complete search history.

(56) References Cited

U.S. PATENT DOCUMENTS

| | | | | |
|---|---|---|---|---|
| 2005/0002191 | A1* | 1/2005 | Shimizu et al. | 362/237 |
| 2005/0225979 | A1* | 10/2005 | Robertson et al. | 362/240 |
| 2008/0239700 | A1* | 10/2008 | Matsumoto | 362/89 |
| 2009/0146575 | A1* | 6/2009 | Chu et al. | 315/247 |
| 2010/0013409 | A1* | 1/2010 | Quek et al. | 315/294 |

* cited by examiner

*Primary Examiner* — Anh Tran
(74) *Attorney, Agent, or Firm* — Jackson IPG PLLC

(57) ABSTRACT

A power supply with dimming control for a high-power DC LED lamp is provided. Particularly, a variable resistor is provided to a circuit of the high-power DC LED lamp for changing a current supplied to a light-emitting unit of the high-power DC LED lamp, thereby adjusting luminance (brightness) and power consumption (consumed watts) of the high-power DC LED unit of the high-power DC LED lamp. The variable resistor is provided to a driver, transformer, adaptor or power supply of the high-power DC LED lamp in a built-in manner or a remotely connected manner.

2 Claims, 4 Drawing Sheets

POWER SUPPLY WITH DIMMING CONTROL FOR HIGH-POWER DC LED LAMP

BACKGROUND OF THE INVENTION

1. Technical Field

The present invention relates to a power supply with dimming control for high-power DC LED lamps. More particularly, the power supply is capable of adjusting luminance (brightness) and power consumption (consumed watts) of a light-emitting unit in a conventional high-power DC LED lamp, and is applicable to dimming control of one or more sets of such high-power DC LED units.

2. Description of Related Art

Referring to FIG. 1, FIG. 4, FIG. 6 and FIG. 8, in the case of average halogen lamps and tungsten filament lamps (incandescent lamps), the dimming control is achieved by changing the voltage or current of a transformer 1 in the lamp. However, to a lamp with a high-power DC LED unit 41, by changing the voltage or current at the input end of its driver 2 is not effective to get significant dimming effects (only a variation about 10%-20%), and doing so can bring additional burdens to the power supply of the high-power DC LED lamp, leading to decreased stability and service life of the lamp. This is because the driver 2 typically provided in such a high-power DC LED lamp offsets the change of the voltage or current made at the input end of the driver 2, so the conventional means for dimming control by changing the voltage or current is inadequate for the light-emitting unit of a high-power DC LED lamp.

In the current technology, there is no way to perform dimming control of the high-power DC LED unit 41 of a high-power DC LED lamp by adjusting a transformer, an adapter/power supply 1, a driver 2 in the burner/bulb or a conventional dimmer.

Therefore, the existing high-power DC LED lamp 4 fails to have dimming control and can be only operated between "on" and "off" and the lack of dimming control weakens the practicability of the existing device.

SUMMARY OF THE INVENTION

For improving the traditional high-power DC LED lamp whose power transformer lacks for dimming control, the inventor of the present invention invited a power supply with dimming control for a high-power DC LED lamp, with the attempt to adjust luminance (brightness) and power consumption (consumed watts) of a light-emitting unit in the high-power DC LED lamp, so as to enhance the practicability and power-saving efficiency of the high-power DC LED lamp. The power supply is characterized in integrating a driver 2, a transformer, and an adapter or a power supply 1 in the high-power DC LED lamp 4 into a whole. The power supply is further provided with a variable resistor 3 for adjusting electric current. Thereby, the power supply is capable of dimming light-emitting unit(s) 41 of one set or more sets of high-power DC LED lamps 4.

BRIEF DESCRIPTION OF THE DRAWINGS

The invention as well as a preferred mode of use, further objectives and advantages thereof will be best understood by reference to the following detailed description of illustrative embodiments when acquire in conjunction with the accompanying drawings, wherein.

DETAILED DESCRIPTION OF THE INVENTION

Figure 1:
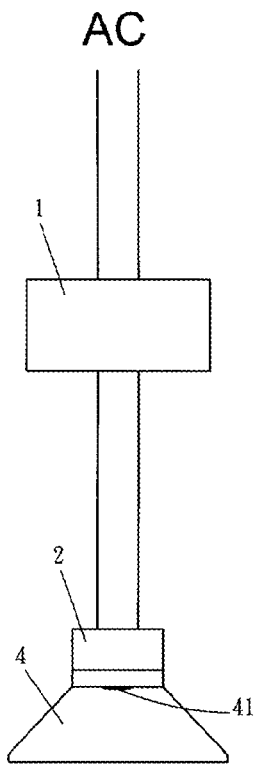
Prior Art Fig.1
FIG. 1 is a schematic drawing showing a conventional high-power DC LED lamp working with an AC-DC transformer.
Figure 2:
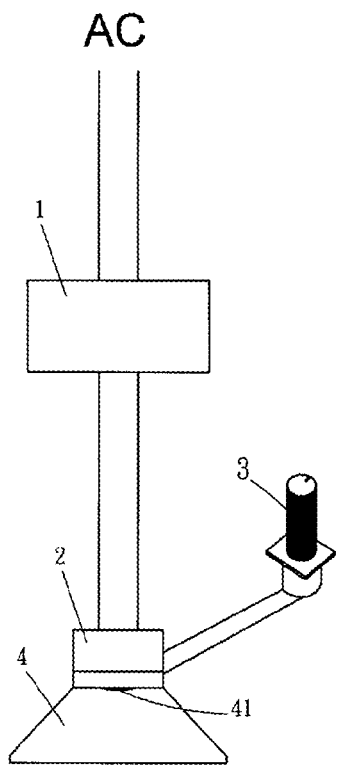
FIG. 2 is a schematic drawing showing the present invention applied to a driver.
Figure 3:
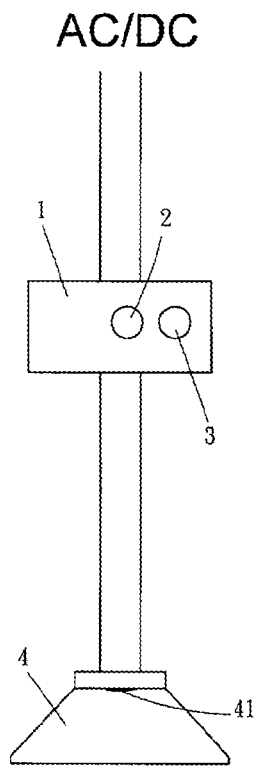
FIG. 3 is a schematic drawing showing the power supply with dimming control applied to a high-power DC LED lamp.
Figure 4:
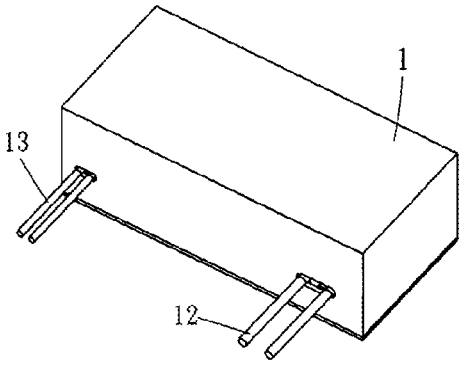
Prior Art Fig.4
FIG. 4 is a perspective view of a conventional AC-DC transformer.
Figure 5:
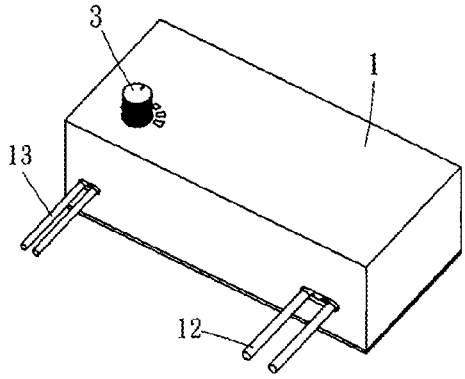
FIG. 5 is a perspective view of an AC-DC transformer equipped with the power supply with dimming control for a high-power DC LED lamp of the present invention.
Figure 6:
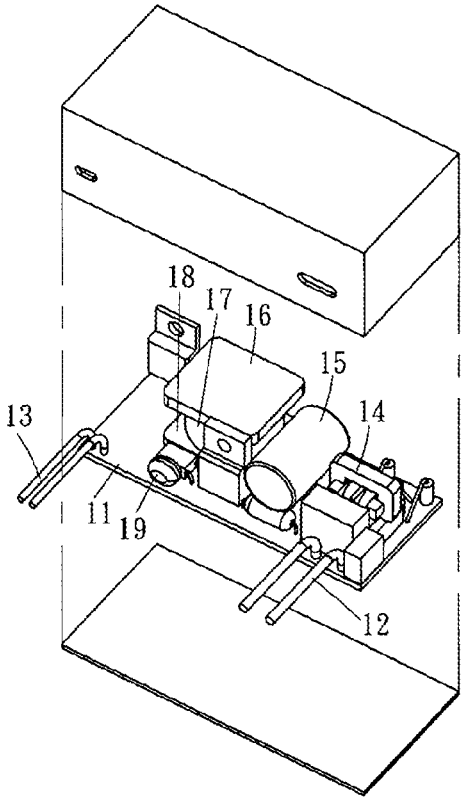
Prior Art Fig.6
FIG. 6 is an exploded view of the conventional AC-DC transformer.
Figure 7:
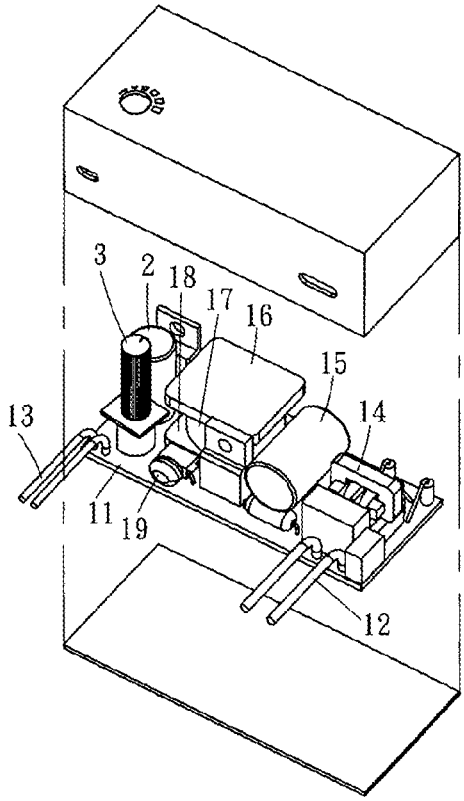
FIG. 7 is an exploded view of the AC-DC transformer equipped with the power supply with dimming control for a high-power DC LED lamp of the present invention.
Figure 8:
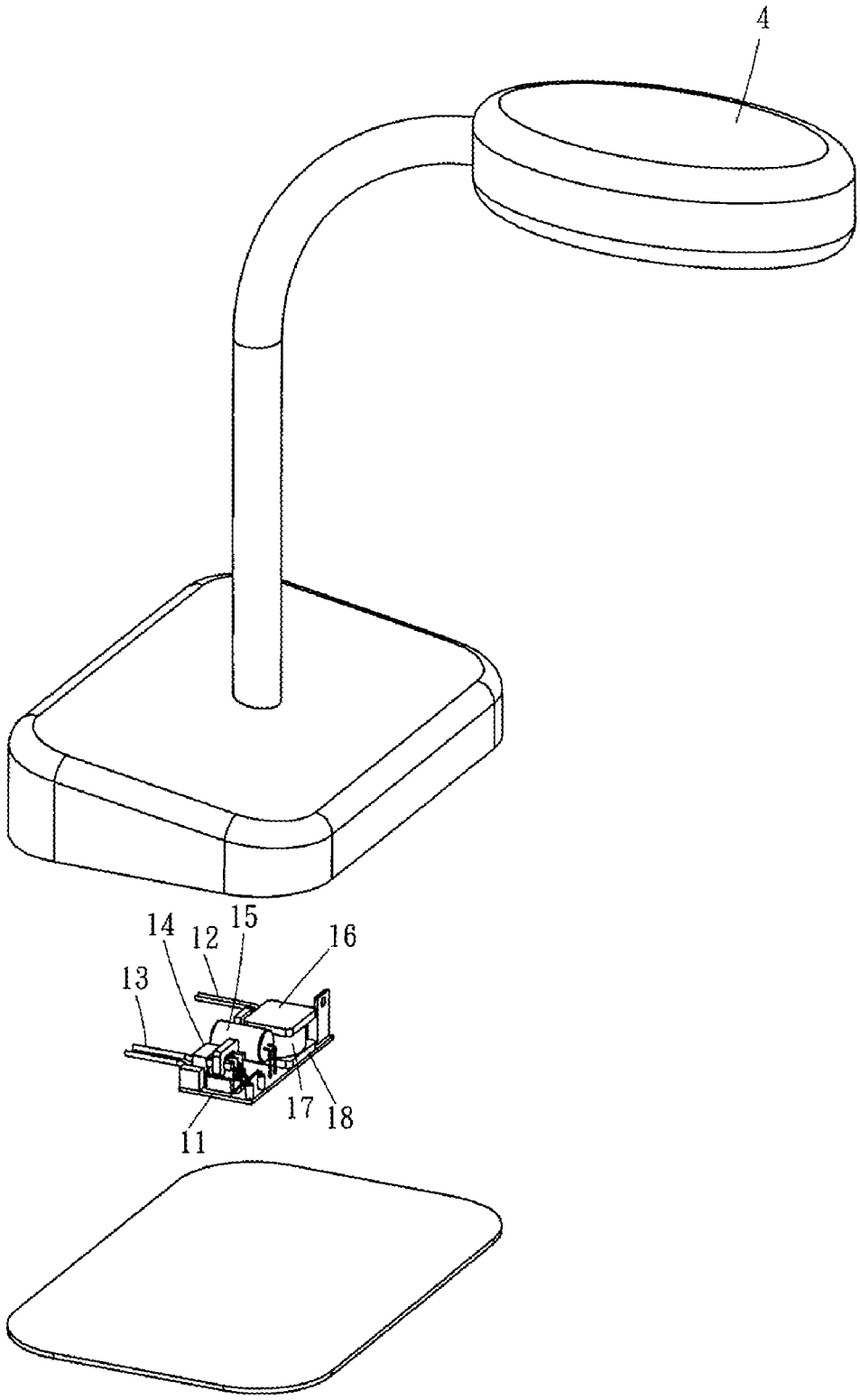
Prior Art Fig.8
FIG. 8 is an exploded view of a conventional high-power DC LED lamp.
Figure 9:
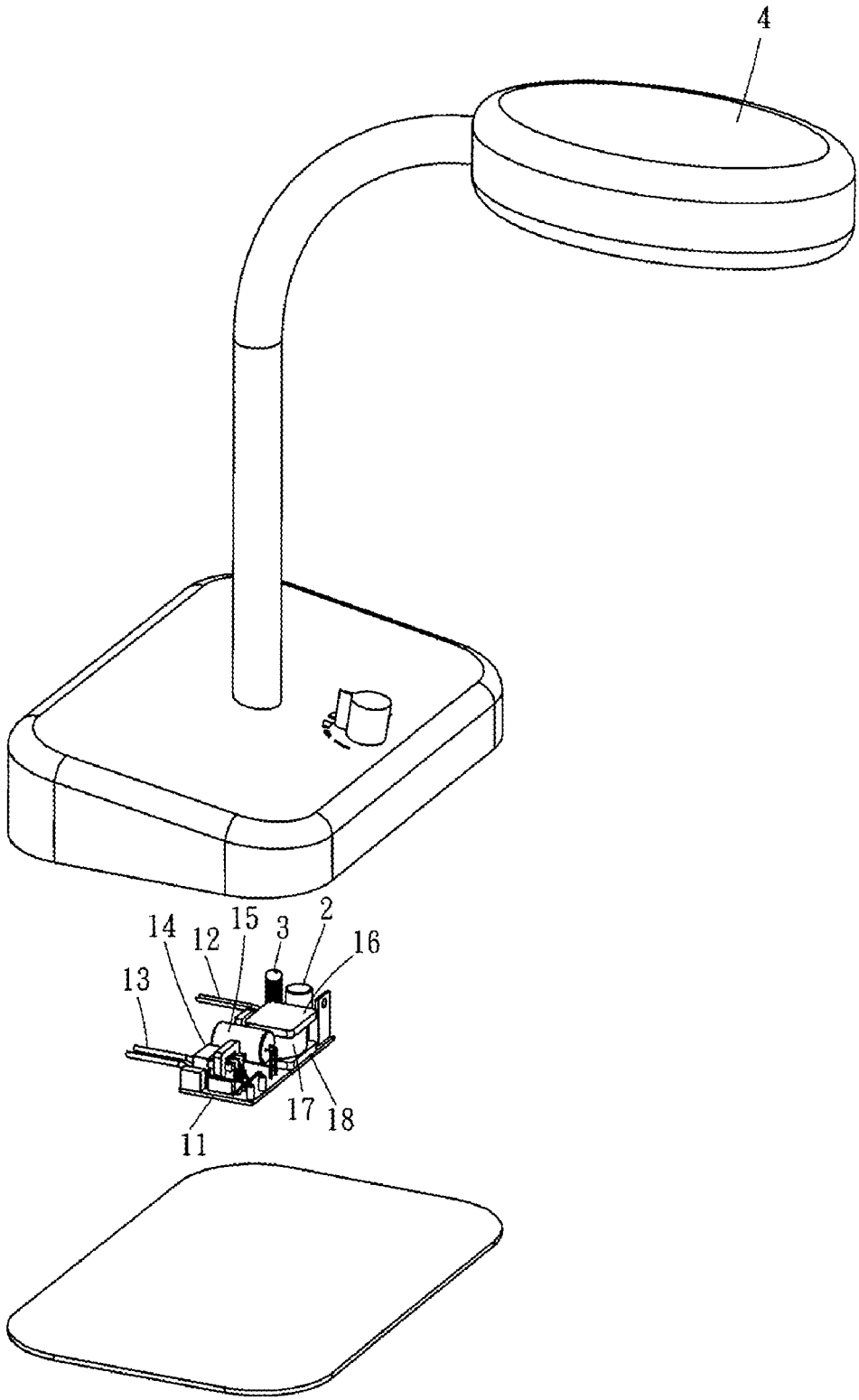
FIG. 9 is a schematic drawing showing the present invention applied to a high-power DC LED lamp.

Referring to FIGS. 1, 2, 3, 5, 7 and 9, a power supply with dimming control for a high-power DC LED lamp of the present invention is primarily configured as below. Between a power input end 12 and a power output end 13 on a circuit board 11 of a normal transformer, adapter or power supply 1, in addition to an inductance loop 14, a capacitor element 15, a filter element 16, a pulse width modulator 17, an overload protection circuit 18 and a feedback control circuit 19 as usually provided, there is specially a variable resistor 3 between the power input end 12 and the power output end 13 on the circuit board 11.

The above configuration serves to adjust an input high voltage (about 90~264V) or low voltage (about 3~48V) into any of the voltage values of 3.5V, 7V, 10.5V, 13.5V, 17.5V, 21V, 25V, 28V, 31.5V, 35V, 38.5V, 42V and higher according to the need of the high-power DC LED, and then the specially provided variable resistor 3 changes a current for the use of the high-power DC LED, thereby adjusting luminance (brightness) and power consumption (consumed watts) of a high-power DC LED unit 41 in the high-power DC LED lamp 4.

In the power supply with dimming control for a high-power DC LED lamp, the high-power DC LED lamp 4 may include one set or more sets of the high-power DC LED lamps 4, and each of the high-power DC LED lamp 4 may have one or more high-power DC LED units 41.

In the power supply with dimming control for a high-power DC LED lamp of the present invention, the adjustable variable resistor 3 is an adjusting element which is rotatable and adjustable/controllable in output current through a wired or wireless way, so as to allow a user to adjust luminance (brightness) and power consumption (consumed watts) of the high-power DC LED unit 41 of the high-power DC LED lamp 4.

In the power supply with dimming control for a high-power DC LED lamp of the present invention, the variable resistor 3 provided to the transformer, adapter or power supply 1, or driver 2 may be provided in a built-in manner or a remotely connected manner.

What is claimed is:

1. A power supply and high-power DC LED lamps with dimming control, being characterized in integrating a transformer, an adapter or a power supply, a driver of a plurality of the high-power DC LED lamps, and a variable resistor comprising an adjusting element that is rotatable and adjustable and controllable through a wired or wireless way so as to control and adjust a current output to a high-power DC LED unit of each of the high-power DC LED lamps, thereby adjusting luminance and power consumption of each high-power DC LED unit of the high-power DC LED lamps.

2. The power supply of claim 1, wherein the high-power DC LED unit of each of the high-power DC LED lamps includes a plurality of the high-power DC LED units.

* * * * *